United States Patent [19]

McDermott

[11] 4,222,260

[45] Sep. 16, 1980

[54] WARM FORGING OF CONNECTING ROD CAPS

[75] Inventor: Richard P. McDermott, Troy, Mich.

[73] Assignee: WSP Industries Corporation, Center Line, Mich.

[21] Appl. No.: 905,831

[22] Filed: May 15, 1978

[51] Int. Cl.[3] ..... B21D 45/00

[52] U.S. Cl. ..... 72/345; 72/342; 72/364; 72/427; 72/352; 148/12 R

[58] Field of Search ..... 148/12 R; 72/364, 427, 72/448, 344, 345, 346, 342, 352

[56] References Cited

U.S. PATENT DOCUMENTS

| | | | |
|---|---|---|---|
| 2,714,450 | 8/1955 | Chestnut | 207/2 |
| 3,370,450 | 2/1960 | Scheucher | 72/354 |
| 3,398,444 | 8/1968 | Nemy | 29/159.2 |
| 3,417,597 | 12/1968 | Napoli | 72/377 |
| 3,583,198 | 6/1971 | Drallmeier | 72/358 |
| 3,631,706 | 1/1972 | Archer | 72/354 |
| 3,691,804 | 9/1972 | Clendenin | 72/358 |
| 3,733,873 | 5/1973 | Ballmer | 72/332 |
| 3,748,887 | 7/1973 | Widera | 72/427 |
| 3,780,553 | 12/1973 | Athey | 72/342 |
| 3,846,183 | 11/1974 | Henry | 148/12 R |
| 3,859,976 | 1/1975 | McWhorter | 74/579 E |
| 4,051,709 | 10/1977 | Sasahara | 72/356 |

*Primary Examiner*—Leon Gilden
*Attorney, Agent, or Firm*—William Kovensky

[57] ABSTRACT

Rod end caps and the method of forming same comprising the steps of using a flashless, closed die set, a predetermined shape and volume billet, warm forging temperatures, and a unique ejector. The ejector pin defines part of the mold cavity when retracted, ejects the finished parts when extended, and locates new billets when in an intermediate position.

13 Claims, 10 Drawing Figures

WARM FORGING OF CONNECTING ROD CAPS

This invention pertains to connecting rod end caps for use in internal combustion engines, and especially to an improved method of making such caps.

A rod end cap is the part in an engine which mates with the large end of the connecting rod and joins the connecting rod to the crankshaft of the engine. The small end of the connecting rod, of course, is connected to a piston.

The cap, in addition to joining the connecting rod to the crankshaft, also provides a counter-weight to balance the moving mass of the piston and the connecting rod. The ends of the cap, a generally crescent shaped part, also include bosses through which bolts are fitted to make the connection to a similar structure on the connecting rod. The inside surface and the bottom surfaces must be finished in order to properly mate with the other parts used with the connecting rod cap.

Heretofore, for larger engines, the caps have been produced by a hot forging technique, using progressive dies, followed by conventional machining of virtually all the surfaces of the cap in order to produce an adequate part. This technique has many disadvantages, namely, the high expense of the progressive dies, the amount of waste material generated in hot forging using such dies, and the expense and opportunities for error in the extensive machining required after adequate forgings are produced.

Furthermore, hot forgings always have scale (which must be removed by shot blasting); and they cannot be formed to the dimensional accuracy of parts made in accordance with the invention.

Other prior art more closely related to the invention involves the manufacture of such caps for very much smaller engines, such as are used in imported cars sold in this country. Such caps do not have nearly the complexity of those required for the larger U.S. manufactured engines, thus making their manufacture in closed dies without a flash much simpler. However, it is believed that even such simpler parts were made in successive stages, and were done at temperatures much closer to hot forging temperatures than the temperatures used in the present invention's technique using warm forging.

In short, none of the prior art contemplates the use of warm forming and the other elements of the invention as set forth below, to produce a part of the complexity contemplated by the present invention in a single hit in a closed die, all as is set forth in greater detail below.

With hot forging it is not possible to reproduce very fine definition of parts—the main reason being that the scale, which is always present at hot forging temperatures, has a tendency to "build up" in the dies, to in turn disrupt production.

There are three generic types or classes of metal forming equipment. These classes are defined by the operating restrictions or characteristics of the particular equipment. The first of these are work-restricted machines (hammers, screw presses, etc.) Here the forming capacity has a maximum value delimited by the knetic energy of the ram or rams immediately in advance of impact. The second of these are power-restricted machines (hydraulic presses) in which the limiting forming load is that imposed by the power available at the hydraulic pump; in general, hydraulic presses can provide maximum forging forces at any or all points in the forging stroke. The last of these are stroke-restricted machines (crank, toggle and knuckle presses etc.) Here, the kinematics of the drive mechanism determine the path-time curve of the ram head.

In the case of stroke and power restricted machines, the machine frame has to be so designed as to withstand the maximum loads involved in forming; stroke restricted machines can be overloaded while power restricted machines cannot. In both cases there is a practical limit to the load which can be applied at a given setting and a corresponding limit to the amount of possible deformation. Multiple blows by either a stroke or power restricted machine are therefore of no effect in increasing deformation beyond that yielded by the first application of load. It is this principle feature combined with a desire to maximize production that makes it necessary to use stroke restricted equipment when considering the manufacture of connecting rod caps with a "single hit" process.

Because of the large annual requirements for connecting rod caps, it is economical to make them on the fastest possible equipment. Therefore, most con-rod caps produced by conventional methods are forged on mechanical, stroke restricted, equipment. By the conventional method the caps are normally formed on multiple impression dies where more than one (normally 4, 6 or 8) cap is formed from the same starting material blank and a rather large flash is generated which keeps them together and absorbs the excess material volume. After successful forging, this non-functional, inter-connecting flash must be trimmed from the parts.

One of the most important elements of the invention is the use of warm forging as opposed to hot forging temperatures. The use of the lower temperatures provides the advantages of reducing and even substantially eliminating the harmful scale or oxide growth on the component as well as enabling the component to be produced to a high dimensional accuracy.

In conjunction with this, the reduced temperature leads to increased die pressures, therefore, an important aspect of the invention is its use of a segmented as opposed to a solid die. In the testing performed during the development of the invention, solid dies were first tried and despite great care in both design and usage, the solid dies cracked under the severe loads imposed in producing a part of the complexity of a rod end cap under the conditions of the invention. The invention segmented die is particularly designed and has many features especially suitable for producing such caps all as will be set forth in greater detail below.

Another element of the invention is the use of a closed die without a flash as opposed to an impression or even open die. Therefore it is, of course, dependent upon a carefully measured billet volume for use in this flashless closed segmented die. The volume of the billet, as well as its shape, must be carefully calculated so that the material in the starting billet will flow throughout the die under the single stroke pressure of the stroke restricted machine to produce the finished part. Thus, two other elements of the invention are the preforming that goes into the billet, and the producing of the finished part in a single hit as opposed to successive formation with a flash with all of its attendant disadvantages.

Yet another element of the invention is the ejector design which is designed to rapidly and accurately remove the finished part from the die after it is completed while at the same time forming a base on which the preformed billet for the next operation can be located so as to prevent the second billet from cocking or being other than perfectly oriented in the die in preparation for its (the second billet's) formation into a rod end cap.

Many other elements go into the invention, and these include the use of suitable lubricants in the die, methods of heating the billets, the materials selected for the dies, the cooling rate of the finished parts which eliminates other subsequent steps thus further enhancing the economic advantages of the invention and the caps produced thereby, the speed at which the mechanical press is driven, and other lesser considerations well known to those skilled in forging techniques.

The above and other advantages of the invention will be pointed out or will become evident in the following detailed description and claims, and in the accompanying drawing also forming a part of the disclosure, in which:

Figure 10:
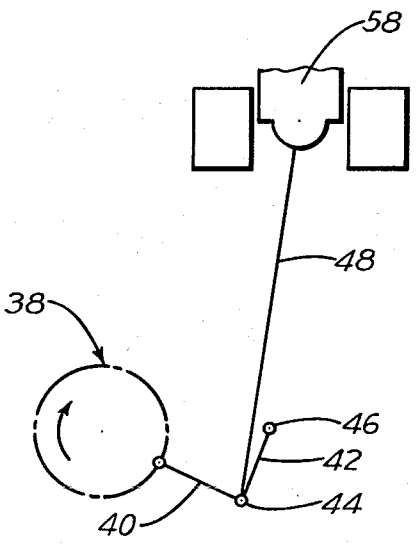
Figure 3:
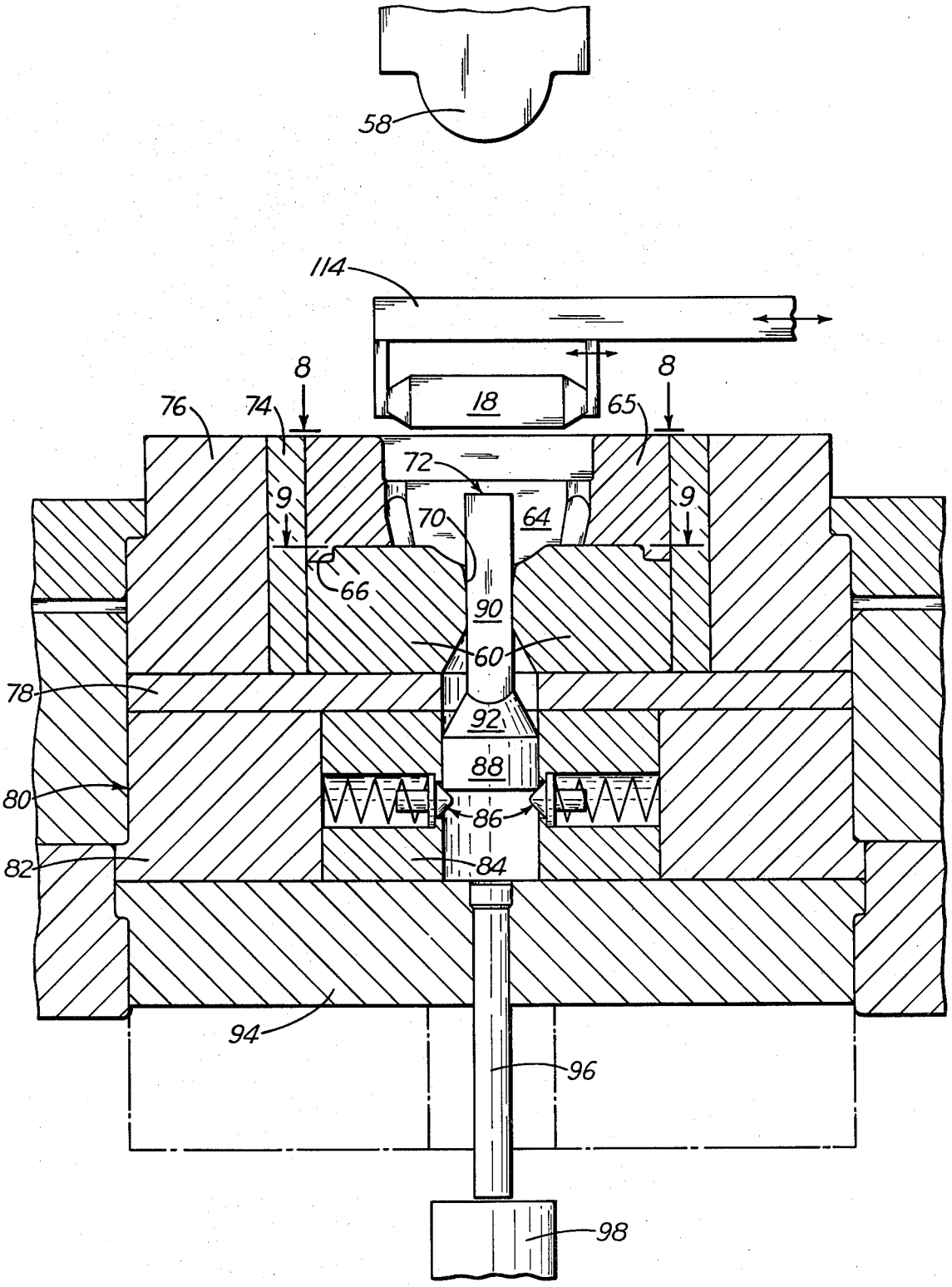
FIGS. 3–7 are sequential views showing the formation of the cap of FIG. 2 in accordance with the invention.
Figure 8:
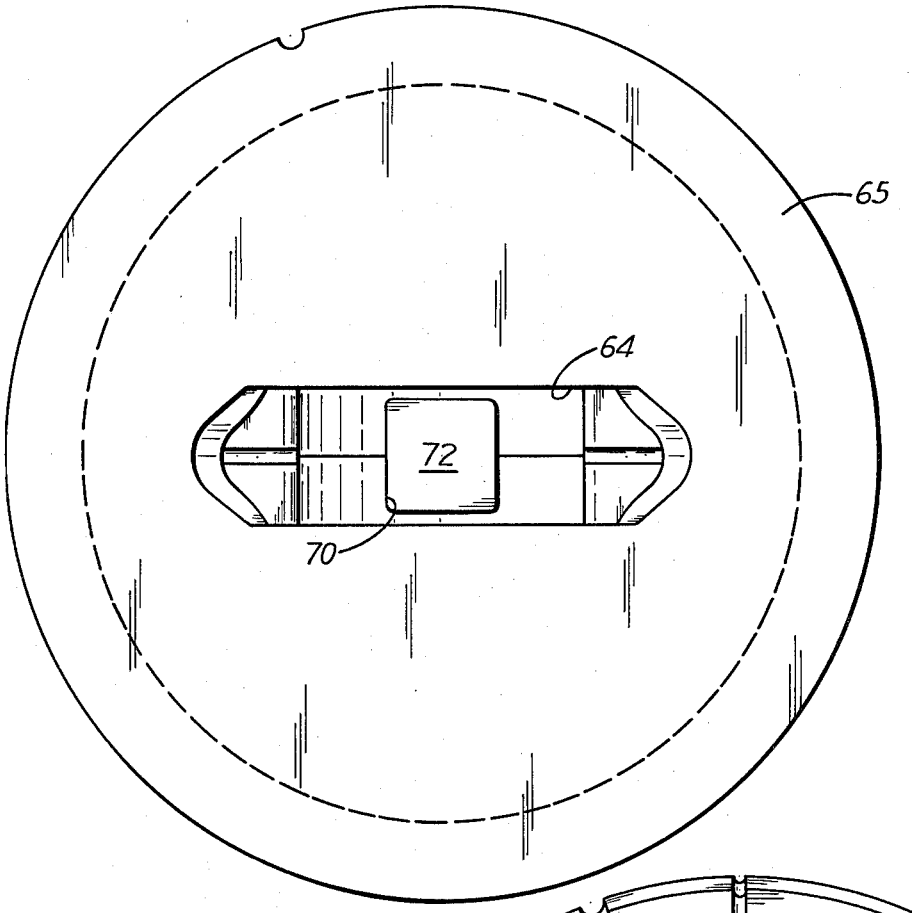
Figure 9:
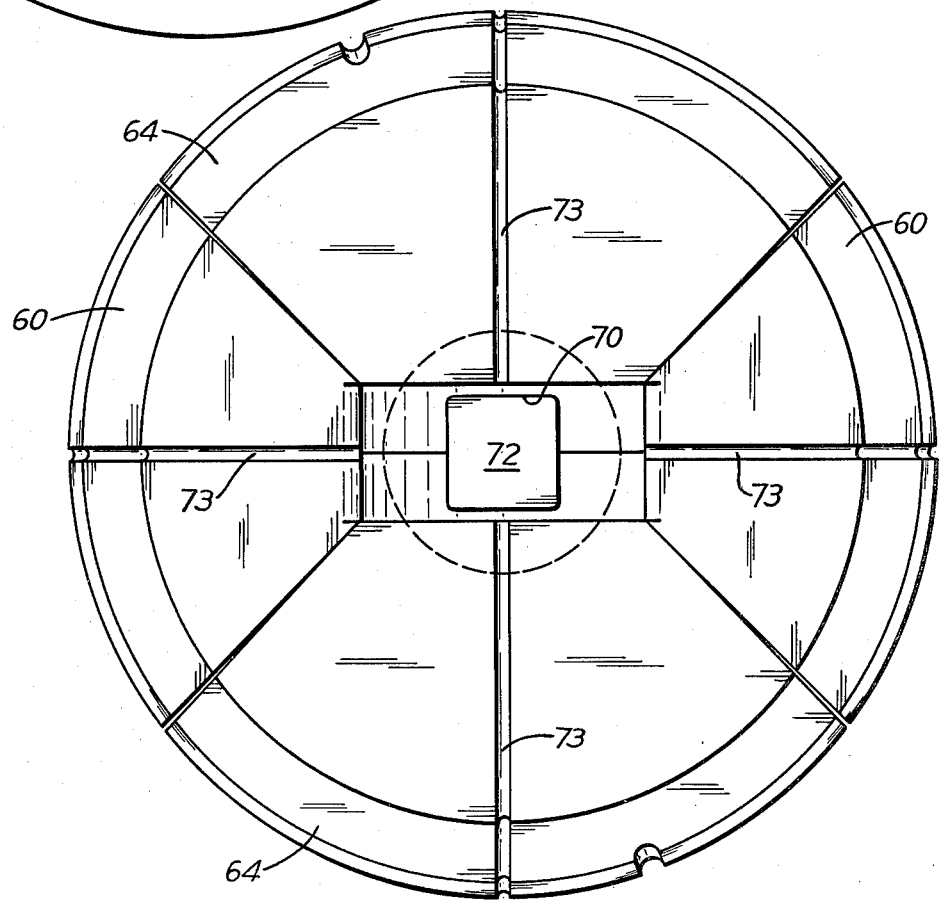

FIGS. 8 and 9 are cross-sectional views of the die taken on lines 8—8 and 9—9, respectively of FIG. 3 showing the makeup of the female die, and FIG. 10 is a schematic view illustrating the concept of operation of a tension knuckle press.

Figure 1:
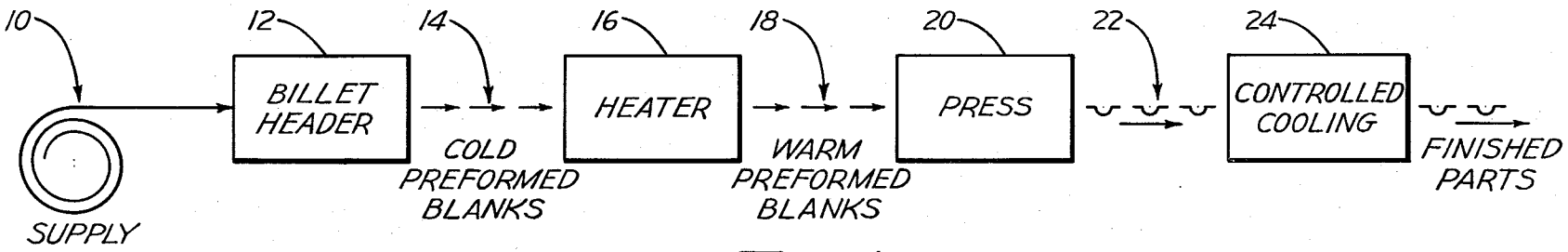
FIG. 1 is a schematic diagram showing the method of the invention.

Referring now to FIG. 1, there is shown a schematic diagram of the invention method. The material, preferably in a coil 10 of round stock, is passed to a parts former or header 12 which produces the predetermined size, shape, weight, and volume of billet 14 required by the invention. These blanks are heated to a predetermined temperature in the warm forging temperature range of 1500°–2000° F., in a heater 16. A range of 1800° F.–1850° F. is preferred. The warm billets 18 then pass on to the press 20 and are formed into the rod end caps 22 of the invention shown in detail in FIG. 2, in a single stroke or "hit" of press 20. Finally, the still warm billets pass on to some controlled cooling means, from which they exit as substantially finished formed parts.

It is an important aspect of the invention that because of reduced dimensional and weight fluctuations of the parts produced, the amount of finish machining can be substantially reduced.

The controlled cooling means 24 can be any of the well known means, for example, various types of tunnels with conveyor belts running through them are routinely used, are inexpensive, and accurately control the time related cooling of hot or warm parts. This controlled cooling aspect of the invention provides important advantages as compared to prior art hot forging techniques.

The automotive industry prefers to finish machine the caps after they are hardened rather than before in order to eliminate warping during heat treating. Since a certain limited amount of machining is required of the parts produced by the invention, and coupled with the possibility of controlling the cooling of a warm forged part, the use of the controlled cooling means 24 produces a fully heat treated part directly from the manufacturing process. Heretofore, hot forged parts were fully cooled and reheated in order to be conventionally heat treated. This separate step is combined with the manufacture as shown in FIG. 1 thereby imparting important economic advantages to the invention system.

The warm finished parts 22 are control cooled down to a predetermined temperature, then quenched conventionally, thus completing the heat treating process and producing parts ready for the finish machining. Of course, the particular cooling rates, temperatures, etc. are a function of the particular material used, and in any case, this aspect is well within the knowledge of persons skilled in the forging arts. For manufacturing caps for American automobiles, the automobile manufacturers specify grade 1541 hot rolled steel. Of course, in other applications other materials could be used, and suitable changes and adjustments and temperatures and the like could be made accordingly.

Figure 2:
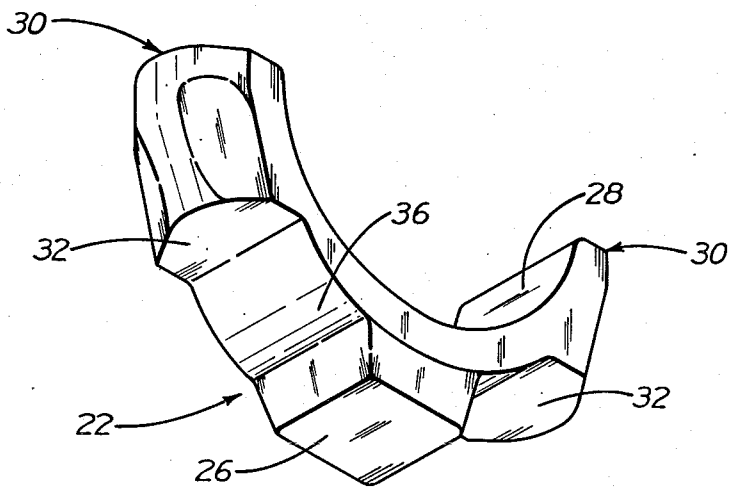
FIG. 2 is a perspective view of a rod end cap produced in accordance with the invention.

Referring now to FIG. 2, a typical cap produced in accordance with the invention is shown in detail. Cap 22 comprises a counter weight portion 26 at the top end and directly opposite the bore 28 against which the crankshaft is received. At its outer ends are "feet" portions 30 which have a boss portion 32 which is later drilled for receiving the bolts which attach the cap 22 to the large end of the connecting rod on the opposite side of the crankshaft. Between the counter weight portion 26 and the foot positions 30, the part 22 comprises a thinned or waist portion 36. It is this configuration of the part 22, i.e., the relatively large amount of metal out at the ends and the relatively large amounts of metal at the middle with the middle and ends being connected by relatively thin portions, that produces the problem solved by the invention, i.e., producing such a cap with a single stroke of a mechanical stroke restricted press.

The means 12 to produce the billets 14 may be a header or parts forming machine as is conventionally used in the metal forming arts. The size and shape of the billet are critical in the method of the invention. The material is usually dictated by the customer, as set forth above. Since the billet is a predetermined length and with the addition of angles and/or curves at the extremities as needed for each particular application, the total volume is therefore also pre-determined. The volume, of course, is calculated to be very closely equal to the volume in the finished part 22 shown in FIG. 2. There are many different and often contradictory considerations. The thicker the diameter of the billet, the more material flow is required. This is so because after being struck, the material, in a relatively thick billet, which must be correspondingly short flow away from the waist portions 36 and towards the heavier portions 26 and 30. On the other hand, a thinner billet permits a longer billet, but increases the possibility of the billet cocking jamming, or not landing properly in the die. This problem was solved with the use of the ejector means in the press 20 described in detail below which permits the use of a relatively long billet. The ratio of the billet diameter to length, when compared to the configuration and material distribution of the finished part, provides an enormous host of considerations and ways in which billet design affects the appearance, performance, quality, grain flow, stresses, strength, and the like in the finished product. The ejector means of the invention permits the designer a great deal more freedom. He may make the billet to the ideal length, diameter, and ratio needed for the particular part for its optimal design, performance and material flow, since the spring loaded detented ejector pin of the invention assures proper seating of the billet in the die prior to forming of the part. Another consideration for making the billet relatively long, which of course is balanced against the other considerations in determining final billet size, is that with a long billet there is less movement of material out to the ends, which movement could cause folds and the like and discontinuities in the finished part.

For high productivity, the heater 16 would preferably be a direct electric heating device such as an induction or resistance heater. Such a device with its associated short heating times reduces scale or oxide growth as compared to a fuel fired furnace.

Before heating, the billets or preforms are coated with a suitable lubricant which acts also as an oxide preventer or retarder. Suitable lubricants include molybdenum disulphide and graphite based lubricants for these uses. If fuel fired furnaces were used instead of electrical furnaces, the lubricant might decompose or be burned off due to the increased heating time, and the surface of the part could have oxide and scale and the like formed on it, which would detract from the finish on the parts 22 exiting the press 20. The surface finish all over the part 22 is suitable for use as is, except for the minor amount of finish machining discussed above. This surface finish is one of the advantages of the invention.

The invention method includes the use of a particular kind of mechanical press known in the art as a tension knuckle press or "Maypres". This machine is characterized by the main driving crank being located below the female die, the male die being located above the female die, with linkages connected from this crank to the male die whereby the male is pulled down into the female rather than being pushed down as in more conventional mechanical stroke restricted presses. The machine includes tension means in the linkage between the crank and the male die so that any play can be taken up after the die is closed rather than before. The tension means or backlash absorbing means entail some tension member in the nature of elastic bands stretched a limited amount, well below their elastic limit, so that a true closed flashless die configuration is obtained. With this particular press, it is thought that the billet weight and size can vary to a tolerance to within $\pm 5\%$ of the ideal perfect or nominal volume of material needed to fill the die to make the part 22. With a conventional overhead push down stroke restricted type machine using a closed die flashless design, this tolerance would have been approximately $\pm\frac{1}{2}$ of 1% of the ideal volume. This additional tolerance on the billet size and weight permitted by this particular press together with the other aspects of the invention method are instrumental to its success.

More in detail, this concept as explained above is shown in the highly schematic drawing of FIG. 10.

The forming speed, that is the rapidity of the strokes of the male die 58, is a complex variable and will be determined with consideration to many factors including the following: lubricating system, forging temperature, die material and die cooling. By way of example, it is anticipated that to manufacture the cap shown in FIG. 2, a forming speed in the neighborhood of 40 strokes per minute will be attainable. This is far in excess of speeds of about 3–10 strokes per minute for conventional hot forging methods. In addition, the parts exiting from this process do not require the trimming operations usually associated with conventional methods.

Referring now to FIGS. 3–9, the operating part of the press 20, namely the male and female dies as well as the modus operandi is illustrated. The male die or punch 58 is a relatively simple part. It is merely the U shaped portion 28 as well as the bottom of the foot portions 32. In the cap 22 illustrated, this is all there is to the male die. In other environments, more detail could be imparted to the male portion.

Referring to the drawings in general terms, the invention contemplates the use of a segmented die to avoid the problems previously encountered with a solid die which was used in testing performed to prove the invention. It was found that a one piece female die could not withstand the forces produced in repeated use in producing such complicated parts in a closed die in accordance with the invention. The invention segmented die provides a number of features which include the use of parting lines along natural lines in the cap, whereby the parting lines are not evident, these lines being as close as possible to the lines of maximum stress, and an ejection pin which has an operating face the same as the top face of the counter weight portion 26 of the part 22, and the use of symmetrical female die pieces.

The ejector pin will form the face of the counter weight portion 26. The female die further comprises two bottom pieces, similar to each other, two similar end pieces, and two similar side pieces. In this way, the interchangeability and replacement of parts is greatly simplified. For example, only one type of end piece need be made and held in readiness in the event of failure. Another feature of the invention, is the use of prestressing means to hold the various female die pieces together which yields the advantages that the entire die may be readily changed in order to prevent excessive down time for routine die maintenance or replacement of broken parts. Heretofore, the machine had to be stopped and several hours of labor expended to change the female die. With the invention technique and the prestressed member holding a complete female die assembly together, such a die can be kept as a spare and replaced very quickly. Various bolts and quick detatchment means are also provided to permit this rapid die change. In tests performed in proving the invention, a complete change of the female die was accomplished in about five minutes. Along this same line the ejection pin means together with the detents used to hold it in a partially extended upright position for locating each successive billet is also a separate module and separately replaceable. This part can be replaced and changed independently of the female die and is located as a separate member below the die. The ejector pin is driven by the conventional ejection means in the press.

Another advantage of the segmented die for manufacturing the caps 22, is that the side pieces which form the bulk of the part but which take the least amount of stress, can be replaced separately from the end pieces which can be made relatively small. The end pieces take the bulk of the stress, in that the material of the billet must be pushed outwardly into the crevices in these end pieces. The ends of the die which require the most frequent replacement are the smallest die pieces, again effecting great economies by the use of the invention in replacement and renewal of the dies. This is coupled with the fact that the end pieces as well as the side pieces, are each identical to each other thus again effecting great economies in the manufacture of the dies. The fine die pieces as well as their cooperation with the ejector pin which forms the face of the counter weight portion 26, are made to mate with other along natural lines in the cap, so that any flash or line which may occur at those segments does not have a detrimental effect, certainly not on performance, and very minimally even on the aesthetics on the finished parts.

Referring now in detail to the drawings, the female die comprises a pair of end pieces 60 identical to each other, and a pair of side pieces 64, one of which only is shown in FIGS. 3–7. A ring 65 sits atop the bottom pieces 60 and 64. Much of the detail of the cap which is of course in die parts 60, 64 and 65 has been omitted for the sake of clarity. The pieces are provided with interfitting shoulders 66 which assure that they will mate together, at least loosely in an initial assembly. Similar shoulders (not shown) are provided between the side pieces and the ends. The side pieces fit together so as to define an opening 70 between themselves through which the invention ejector pin 72 fits. Air vent slots 73 are provided as is conventional. The die pieces are held together by a tension ring 74. It is a simple matter to adjust the shape of the die parts to accommodate the natural parting lines to fit a particular cap.

The five die parts are assembled together with a relatively light force in the ring 74. The assemblage in turn is mounted with an extremely heavy force in a relatively larger block 76. This block 76 is the one which provides the real strength of the assemblage of the female die. The material used has a characteristic that it is extremely strong in compression but less strong in tension. Thus, this assemblage of tension rings, the parts 74 and 76, uses this natural strength to produce an extremely strong female die. The female die is prestressed by the heavy load into block 76. The parts 60–76 as an assembled female die may be kept aside as a finished part ready to be substituted in the event of any malfunction in any part of a die. This is the manner in which the great economies of the invention are achieved. It is anticipated that the assemblage of the die parts in the ring 74 will be mounted into the outer main rings 76 with a pressure in the range of about 100–200 KPSI preload. The preload itself is a functional element in that it aids the die in its resistance to spreading or cracking when subjected to the large forces required to form the caps and also brings the segments into intimate contact. These pressure forces are anticipated of being in the range of about 250–350 KPSI.

The inside of the part 74 is at a slight angle, on the order of $\frac{1}{2}°$–2°, to the axis of the die, so that maximum force can be applied to hold the parts together.

A plate 78 separates the die portion from the ejector means 80. The ejector means are an important part of the invention. In addition to the normal function of ejector means in forging and molding operations, in the present invention the ejector means also serve as a locating means for locating a new billet at the beginning of each operation after having ejected the finished part at the end of the preceding operation and as an active element in the female die itself. This portion of the invention greatly simplifies the automatic feeding of billets, and at the same time, as described above, allows great freedom to the user as to length and diameter of the billet. That is, the designer need not depend so heavily on the thickness and length of the billet per se to locate the billet in the die since the ejector pin when in the intermediate position serves this function. Careful loading and locating means are eliminated, the billets can be moved over the open female die and simply dropped in, their proper location in the die being automatically accomplished because of the length of the billet and the size of the ejector means and other portions of the die.

The ejector means includes spring loaded detents which hold the ejector in a partial raised position, but which, upon application of a force from the male die, snap out of the way to allow the ejector pin to retract to permit ordinary and proper forming of the billet into a cap. Further, the invention is used with air jets or the like which blow or otherwise remove the finished part away from the die after they are raised fully up out of the die by the ejector means.

For ease of maintenance and replacement of parts, the detent means are carried in a separate detent bushing, which is itself an integral and replaceable part which can be handled without unduly disturbing the entire die setup.

To these ends, the ejector means 80 comprise an outer ejector ring 82 in which is carried the detent bushing 84. This bushing carries a pair of conventional spring loaded detent means 86. The noses of the detent means are shaped so as to permit the detent members to rotate in use, to even out wear, and to permit the ejector pin 72 to pass above and below the spring pins 86, as is evident from FIGS. 3–7.

Figure 5:
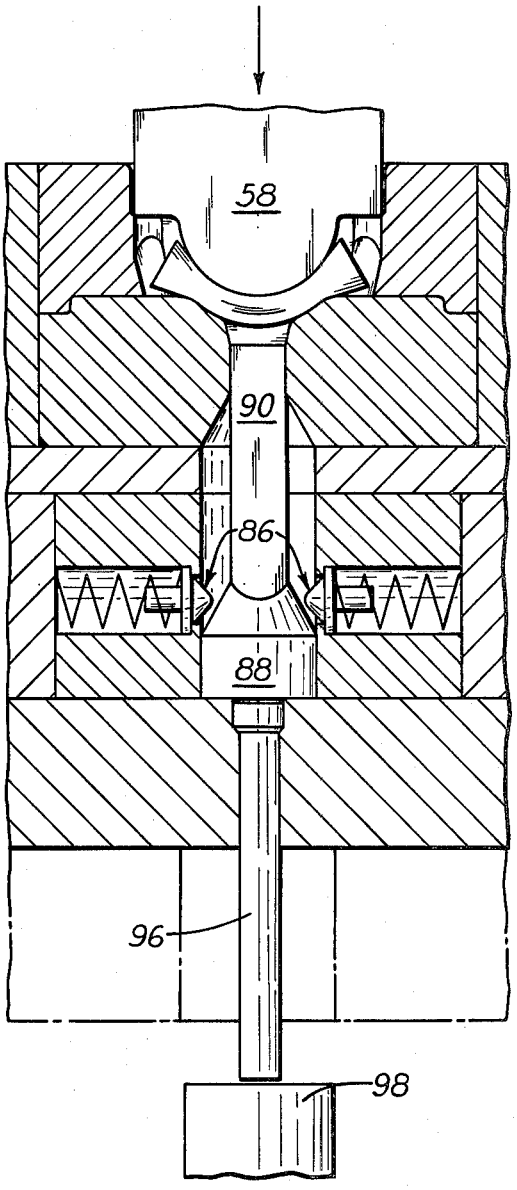

The shank of the ejector pin 72 is of rectangular cross-sectional shape to form the end of the counter weight portion 26 of the cap when the pin is fully retracted, see FIG. 5. The inner end of the ejector pin 72 has an enlarged circular portion 88, which is squared off at its inside end, and which is joined to the shank portion 90 by a conical portion 92.

The female die stack is completed by a bottom plate 94 in which is mounted an ejector driver pin 96. Pin 96 cooperates with a member 98 in the press, i.e., the normal member in the press which is used to drive the ejection means in the die.

Figure 4:
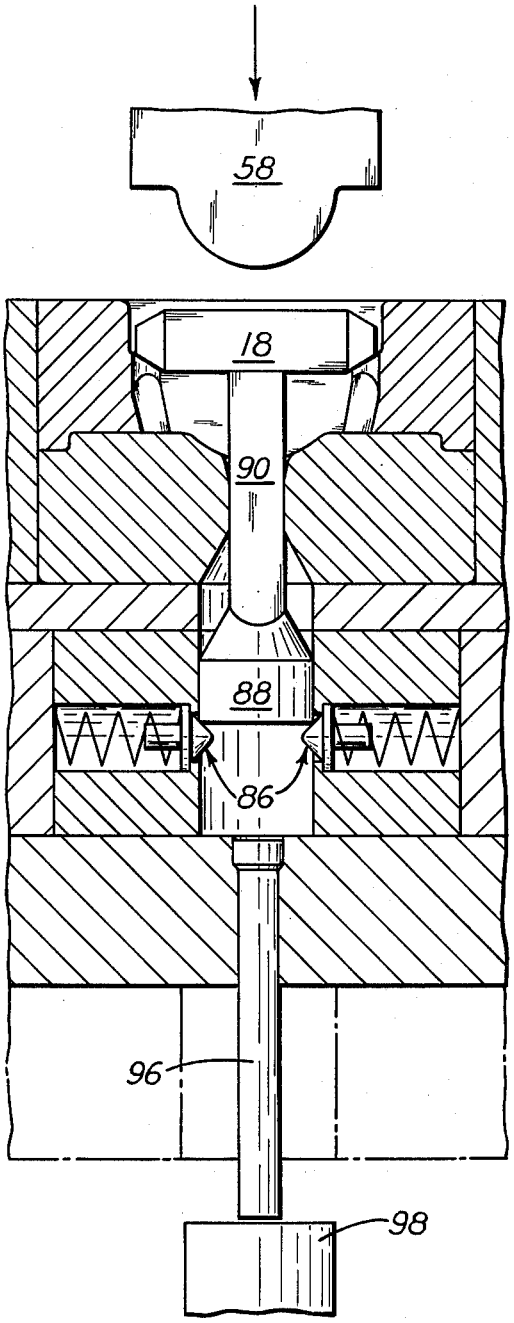
Figure 6:
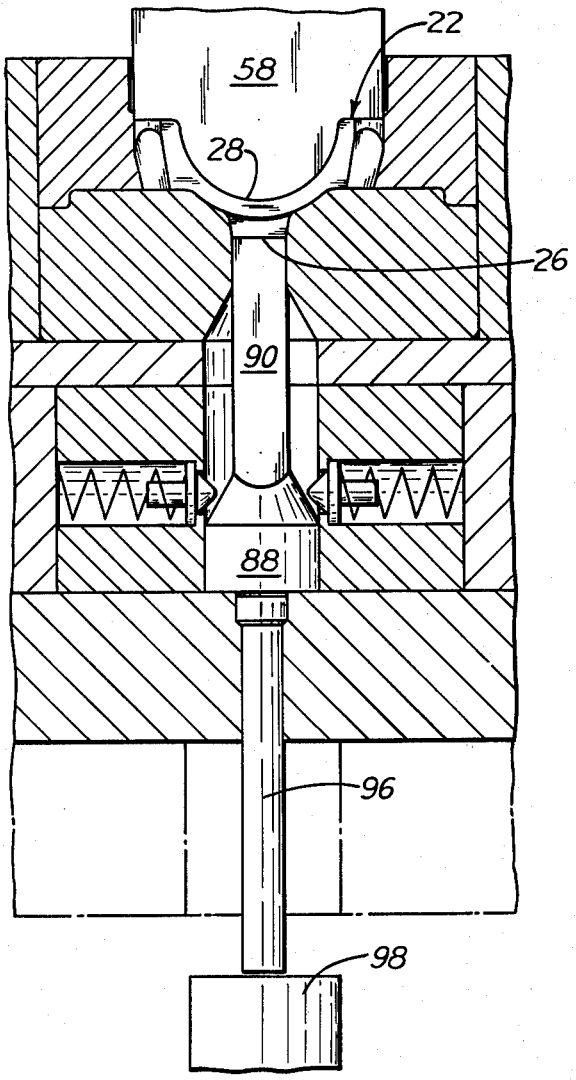
Figure 7:
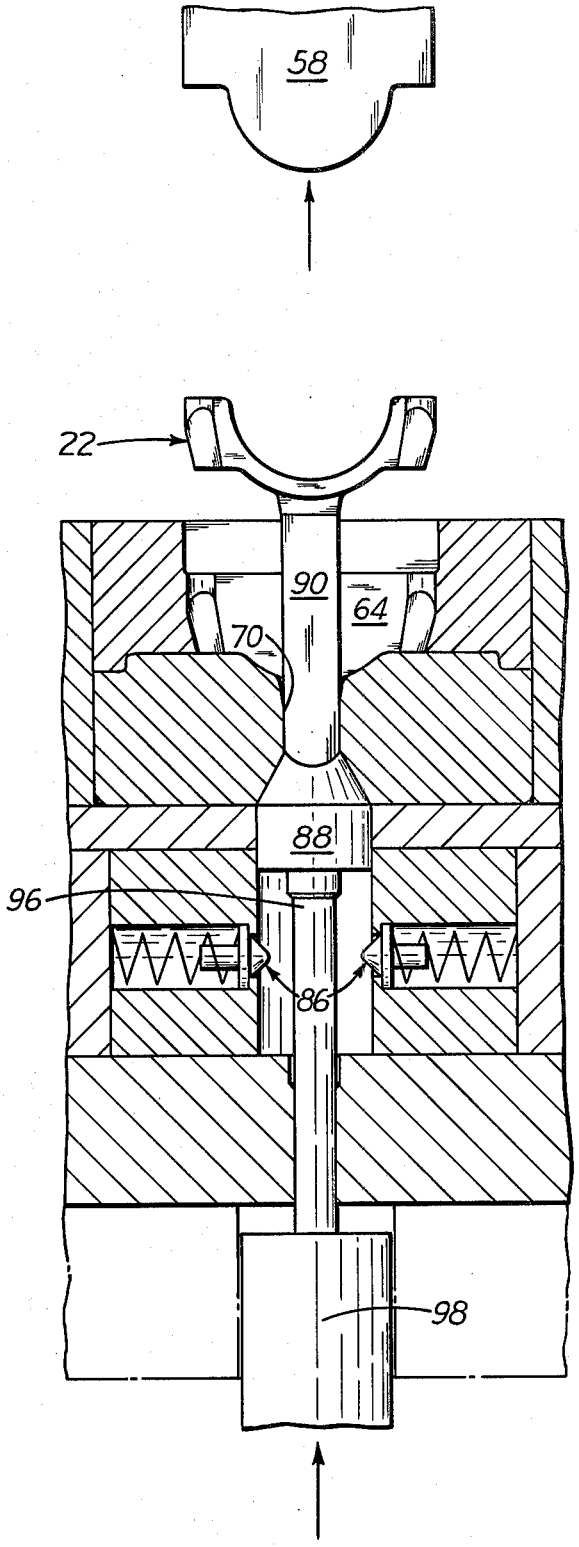

FIG. 3 shows the beginning of operations, or the beginning of a cycle during continuous operation. The invention uses some conventional material conveying means 114 shown schematically in the drawing as a remote controlled clamp member. What is required is something to pick up the billets 18 from the heater, carry them to a predetermined location over the opening in the female die, the male die being raised out of the way as shown in FIG. 3, and then releasing the billet so that it simply drops into the die. In FIG. 4 the conveying means 114 have retracted and are removed, the ejector pin is still held in the up position by the spring detents, and the punch stroke of the male die is about to begin. In FIG. 5 the part is shown half formed. It should be noted that the ejector pin has fallen below the spring detents. Some of the metal has been pushed down into the cavity between the bottom die part and is formed by the top surface of the ejector pin to thereby define the counter weight portion of the cap. It should be noted that at this stage the bulk of the part has a uniform thickness, with all the metal required having been squeezed into the counter weight portion, and the remaining metal now in the waist portions in the process of being squeezed outwardly to form the feet portions. In FIG. 6 the part has been completed; the male die has completed its downward stroke. In FIG. 7 the members 98 and 96 have been driven fully upwardly by the press, past the spring detent means, and the completed part is extending upwardly above the female die and is awaiting removal. The next cycle begins at FIG. 3, the parts 96 and 98 will be in their retracted position, the ejector pin 72 will fall backward to only the FIG. 3 position wherein it is resting upon the spring detents 96 in order to be ready to locate the new billet as shown in FIG. 4 to thereby repeat the cycle.

While the invention has been described in detail above, it is to be understood that this detailed description is by way of example only, and the protection granted is to be limited only within the spirit of the invention and the scope of the following claims.

We claim:

1. In a method of warm forging complex parts in a closed die, a use of an ejector pin comprising the sequential steps of:

1. using said ejector pin when at a predetermined intermediate position between fully retracted and fully extended to act as a locating means for a new billet dropped into the female die;
2. using said ejector pin when at its fully retracted position to act as part of the mold cavity to define a portion of the part to be forged therein; and
3. using said ejector pin when at a fully extended position to act conventionally to eject a finished part.

2. The method of claim 1, and the step of mounting said closed die in a mechanical stroke restricted press.

3. The method of claim 2, and operating said press to form said parts at a rate of approximately 40 parts per minute.

4. The method of claim 3, and using a tension-knuckle type press.

5. The method of claim 1, utilizing a segmented female die in said closed die, arranging the segments of said female die to surround said ejector pin, and providing identical end pieces and identical side pieces in said segmented female die.

6. The method of claim 1, utilizing a segmented female die in said closed die, and preassembling the female die parts into an assembly member, whereby female dies may be preassembled and may be interchanged readily without unduly stopping the warm forging production of said parts.

7. The method of claim 1, utilizing mating male and female dies in said closed die, orienting the female die with its opening facing upwardly, providing an inner end of said ejector pin cooperable with detent means adapted to hold said ejector pin in said predetermined intermediate position in said female die in accordance with step 1, using means in the press in which said die set is mounted to fully extend said ejector pin in accordance with step 3, and providing that said predetermined intermediate position of said ejector pin of step 1 wherein said ejector pin locates a new billet in said female die in such that said new billet is precluded from cocking or taking any orientation other than a predetermined correct orientation when said new billet is dropped into said female die.

8. The method of claim 1, wherein each said complex part warm forged is a connecting rod end cap, the method further comprising the steps of preparing a billet of a predetermined volume substantially equal to the volume of said cap, heating said billet to a predetermined warm forging temperature, delivering said heated billet into the female die of said set in accordance with step 1, using mating male and female dies in said closed die, using the male die acting via said billet to cause the ejector to retract fully into said female die out of contract with said billet to thereby practice the method from step 1 to step 2, using said male die and said ejector pin in accordance with step 2 to form said cap in a single stroke of said male die into said female die and onto said billet, withdrawing said male die after said cap is formed, and fully extending said ejector to eject a warm forged cap from said female die in accordance with step 3.

9. The method of claim 8, using billets of generally cylindrical configuration and of a predetermined length and diameter, and delivering each said billet to said female die in step 1 with its axis generally perpendicular to the line defined by the motion of said male die.

10. The method of claim 8, and heating said billet to a temperature in the range of about 1500° F. to about 2000° F.

11. The method of claim 10, heating said billet to a temperature of about 1800° F. to about 1850° F.

12. The method of claim 8, and using direct electric induction heating means for said heating step.

13. The method of claim 8, and the additional steps of controlling the cooling of said caps after said caps are ejected from said dies, whereby the controlled cooled finished caps may be quenched and thus heat treated to predetermined conditions without first cooling and then re-heating the caps.

* * * * *

UNITED STATES PATENT AND TRADEMARK OFFICE

CERTIFICATE OF CORRECTION

PATENT NO. : 4,222,260

DATED : September 16, 1980

INVENTOR(S) : Richard P. McDermott

It is certified that error appears in the above-identified patent and that said Letters Patent are hereby corrected as shown below:

Assignee "WSP" should read --MSP--.

Claim 8, column 10, line 16:

add after "said" --die--.

Claim 8, column 10, line 20:

change "contract" to read --contact--.

Signed and Sealed this

*Thirteenth* Day of *January 1981*

[SEAL]

*Attest:*

SIDNEY A. DIAMOND

*Attesting Officer*

*Commissioner of Patents and Trademarks*